US010160619B2

(12) United States Patent
Hamlett et al.

(10) Patent No.: US 10,160,619 B2
(45) Date of Patent: Dec. 25, 2018

(54) UNDER CAR POWER UNIT FOR AN ELEVATOR SYSTEM

(71) Applicant: ThyssenKrupp Elevator Corporation, Atlanta, GA (US)

(72) Inventors: Anthony Frank Hamlett, Franklin, TN (US); Aaron Bailey, Germantown, TN (US); Chris B. Jackson, Blue Mountain, MS (US); Sang Choi, Lakeland, TN (US)

(73) Assignee: ThyssenKrupp Elevator Corporation, Atlanta, GA (US)

( * ) Notice: Subject to any disclaimer, the term of this patent is extended or adjusted under 35 U.S.C. 154(b) by 1214 days.

(21) Appl. No.: 14/320,439

(22) Filed: Jun. 30, 2014

(65) Prior Publication Data

US 2015/0375962 A1 Dec. 31, 2015

(51) Int. Cl.

| | |
|---|---|
| ***B66B 1/34*** | (2006.01) |
| ***B66B 5/02*** | (2006.01) |
| ***B66B 11/04*** | (2006.01) |
| ***B66B 9/04*** | (2006.01) |

(52) U.S. Cl.

CPC ..... *B66B 5/022* (2013.01); *B66B 9/04* (2013.01); *B66B 11/0423* (2013.01)

(58) Field of Classification Search

CPC ..... B66B 5/022; B66B 9/04; B66B 11/0423
USPC ..... 187/247, 391, 393, 250, 277, 285, 414
See application file for complete search history.

(56) References Cited

U.S. PATENT DOCUMENTS

| | | | | |
|---|---|---|---|---|
| 4,807,724 | A * | 2/1989 | Martin | B66B 9/04 187/272 |
| 5,078,236 | A * | 1/1992 | Shimoaki | B66B 1/24 187/285 |
| 6,223,860 | B1 * | 5/2001 | Namba | B66B 11/001 187/277 |
| 6,321,876 | B1 * | 11/2001 | Kawai | B66B 5/022 187/391 |
| 6,371,005 | B1 * | 4/2002 | Foschini | B66B 5/028 187/285 |
| 6,378,661 | B1 * | 4/2002 | Arabori | B66B 11/0015 187/250 |
| 6,390,780 | B1 * | 5/2002 | Batchelder | F04D 15/0236 417/17 |

(Continued)

OTHER PUBLICATIONS

Engineering Confidence. enduraMRL, ThyssenKrupp Elevator, Frisco, TX, 2013, 5 pgs.

(Continued)

*Primary Examiner* — Anthony Salata
(74) *Attorney, Agent, or Firm* — Frost Brown Todd LLC

(57) ABSTRACT

A hydraulic elevator system includes a power unit and elevator controller where the elevator car is controlled within the hoistway when a portion of the hoistway might be flooded. The power unit includes a water tight tank having a ventilation tube or snorkel. A moisture sensor is connected with the elevator controller, and positioned within the pit of the hoistway. The moisture sensor detects the existence of a flooded pit condition and communicates such a condition to the elevator controller. The elevator controller initiates a safety sequence when the presence of a flooded pit condition is detected to prevent the elevator car from entering a flooded area of the hoistway.

18 Claims, 8 Drawing Sheets

(56) References Cited

U.S. PATENT DOCUMENTS

| | | | | |
|---|---|---|---|---|
| 7,131,330 | B2 * | 11/2006 | Gurega | F04D 15/0218 73/306 |
| 7,182,174 | B2 * | 2/2007 | Parrini | B66B 5/022 182/18 |
| 8,051,955 | B2 * | 11/2011 | Therriault | B66B 5/0006 187/247 |
| 9,517,921 | B2 * | 12/2016 | Stofira | B66B 11/002 |
| 2002/0139620 | A1 * | 10/2002 | Lamb | B66B 9/04 187/272 |
| 2005/0235822 | A1 * | 10/2005 | Paduano | B66B 9/04 92/86 |

OTHER PUBLICATIONS

HydroFit, Machine-roomless holeless hydraulic elevator, OTIS, 2013, 8 pgs.

* cited by examiner

UNDER CAR POWER UNIT FOR AN ELEVATOR SYSTEM

BACKGROUND

Some conventional elevator systems comprise elevator cars traveling through a hoistway via actuation of a hydraulic jack. In some hydraulic elevator systems, various components for driving the elevator may be located in a separate machine room. Separate machine rooms require additional dedicated building space. Some hydraulic elevator systems attempt to omit the machine room by placing components within the elevator shaft or hoistway on a side of the elevator car, and accessing such components through a closet door next to the elevator within the building. While a variety of hydraulic elevator systems have been made and used, it is believed that no one prior to the inventors has made or used an invention as described herein.

SUMMARY

The present disclosure shows and describes a hydraulic elevator system. It is one object of the present disclosure to provide a power unit that can withstand flooded pit conditions. It is another object of the present disclosure to detect moisture within the pit of the system and restrict the position of the elevator car in response to detected moisture so as to avoid the elevator car from traveling to a portion of the hoistway that might be flooded. In one aspect of the present disclosure, a power unit of the system is located beneath a bottom landing in a pit of a hoistway. In another aspect the power unit includes a water tight tank. In another aspect the tank includes a ventilation tube or snorkel that can allow air to exchange between an interior of the tank and an exterior of the tank. In another aspect the system includes a moisture sensor configured to detect the presence of moisture and signal to an elevator controller that moisture is present. Other aspects, features, and techniques within the scope of the present disclosure will become more apparent to those of ordinary skill in the art from the following description taken in conjunction with the drawings

BRIEF DESCRIPTION OF THE DRAWINGS

While the specification concludes with claims which particularly point out and distinctly claim the invention, it is believed the present invention will be better understood from the following description of certain embodiments taken in conjunction with the accompanying drawings, in which like reference numerals identify the same elements.

Figure 1:
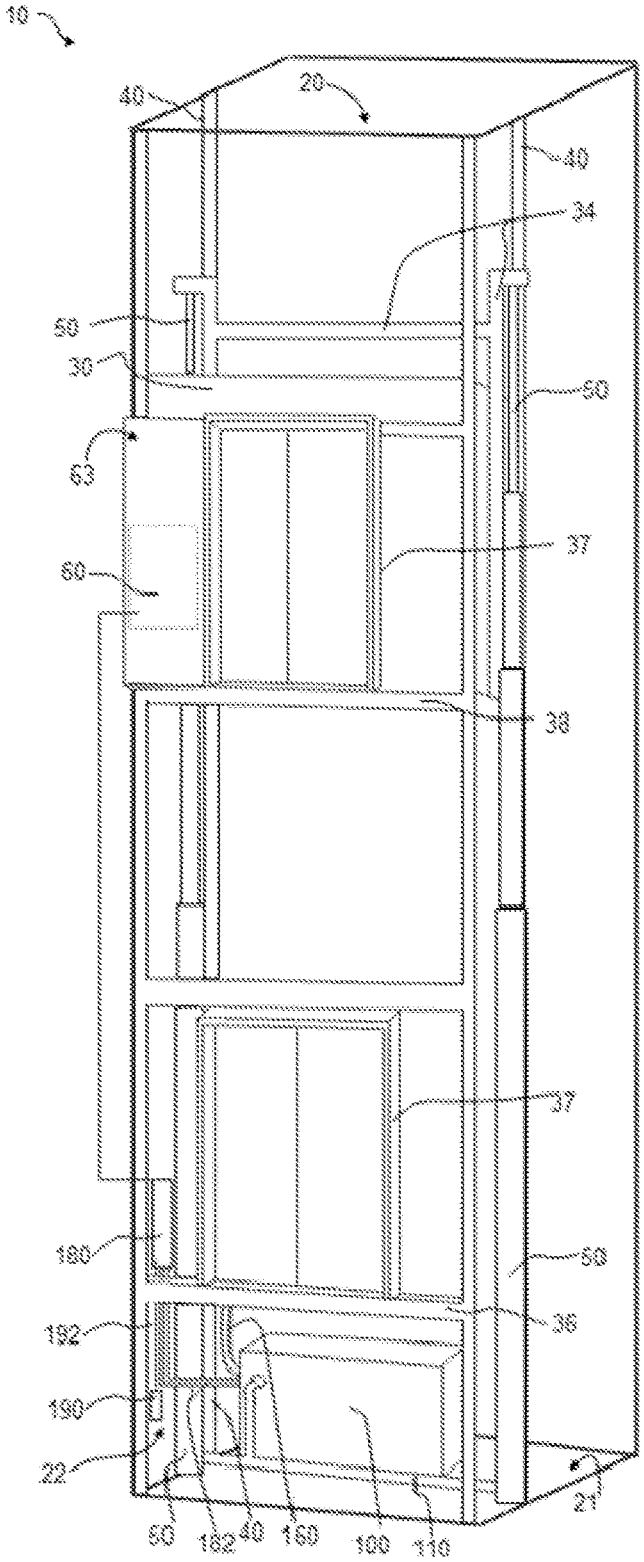
FIG. 1 depicts a schematic view of an embodiment of an elevator system incorporating an under car power unit.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain embodiments of the present disclosure should not be used to limit the scope of the present disclosure. Other examples, features, aspects, embodiments, and advantages of the invention will become apparent to those skilled in the art from the following description, which is by way of illustration, one of the best modes contemplated for carrying out the invention. As will be realized, various aspects of the present disclosure may take alternate forms, or have alternate or additional embodiments, without departing from the scope of the present disclosure. Accordingly, the drawings and descriptions should be regarded as illustrative in nature and not restrictive.

FIG. 1 depicts a schematic of an embodiment of a hydraulic elevator system (10) as disclosed herein. Hydraulic elevator system (10) comprises a hoistway (20), an elevator car (30), guide rails (40), hydraulic jacks (50), a controller (60) mounted in a control cabinet (63), and a power unit (100). Elevator system (10) also comprises a junction box (180) and a moisture sensor (190) that are connected with controller (60) by way of conduits. Hoistway (20) provides a space through which elevator car (30) can be vertically translated along guide rails (40). Hoistway (20) also provides a space to mount guide rails (40) and hydraulic jacks (50). Additionally, hoistway (20) is shown as including a pit (22). Pit (22) is a space below the lowest vertical translation point of elevator car (30). As can be seen, pit (22) is configured to house power unit (100) and other components of hydraulic elevator system (10), as will be described in greater detail below. In this fashion, power unit (100) is located under elevator car (30).

FIG. 1 depicts controller (60) being disposed at a door frame (37) of the second floor landing (38). In alternative embodiments, the controller may be disposed at a door frame (37) of a lowest-most building floor or landing (36). In yet other embodiments, the controller may be located outside the elevator hoistway entirely.

Figure 2:
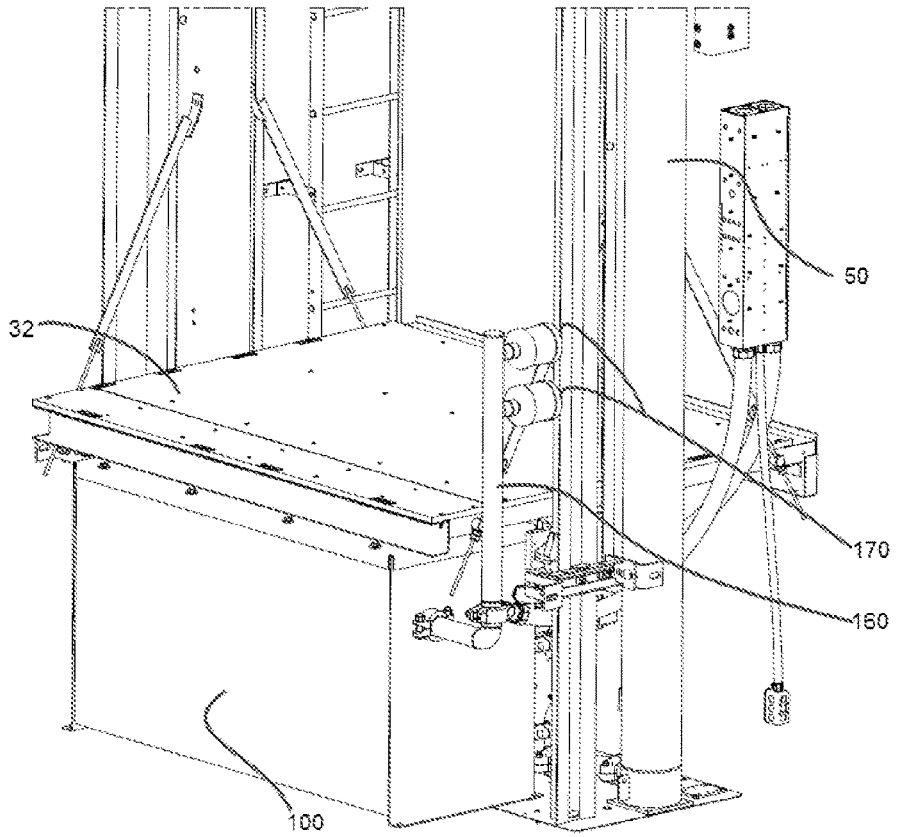
FIG. 2 depicts a perspective view of the under car power unit of FIG. 1, shown within the pit of an elevator hoistway.

Elevator car (30) is driven by actuation of hydraulic jacks (50) as seen in FIG. 2. In particular, an upper portion of each hydraulic jack (50) is mountable to a frame or a sling portion (34) of elevator car (30). Each hydraulic jack (50) is configured to articulate the upper portion relative to the base of hydraulic jack (50). Accordingly, elevator car (30) may upwardly translate as hydraulic jacks (50) are articulated or extended. Likewise, elevator car (30) may downwardly translate as hydraulic jacks (50) are retracted from an articulated or extended position. In some embodiments, hydraulic jacks (50) may comprise multiple articulating portions or rams. In yet other embodiments, hydraulic jacks (50) may comprise a single articulating portion or ram. In alternate embodiments, other suitable arrangements for hydraulic jack (50) may be used without departing from the scope of the present disclosure, and will be apparent to one of ordinary skill in the art in view of the teachings disclosed herein.

The extension and retraction of hydraulic jacks (50) is facilitated by oil or other hydraulic fluid. In particular, hydraulic fluid may be pumped into hydraulic jacks (50) by power unit (100). The hydraulic ram (or rams) may act as a piston thus extending or retracting hydraulic jack (50) as hydraulic fluid is pumped into or relieved from hydraulic jack (50).

FIG. 2 depicts a more detailed perspective view of certain components of hydraulic elevator system (10). In particular, a platform (32) is shown in its lowest most vertical position with power unit (100) placed directly below. Platform (32) represents the floor of elevator car (30) and platform (32) is connected to car sling (34) as discussed above. At the lowest most vertical position, platform (32) may be aligned with the bottom or lowest-most building floor or landing (36), such as a ground level lobby, below ground level floor, or above ground level floor. Accordingly, pit (22) may be below ground level, but could also be at ground level or above ground level. In the present embodiment, power unit (100) is oriented within pit (22) such that contact with other hydraulic elevator system (10) components (e.g., brackets connecting platform (30) to hydraulic jacks (50) etc.) is avoided. The orientation depicted also permits oil lines (110) to run between power unit (100) and hydraulic jacks (50).

Figure 3:
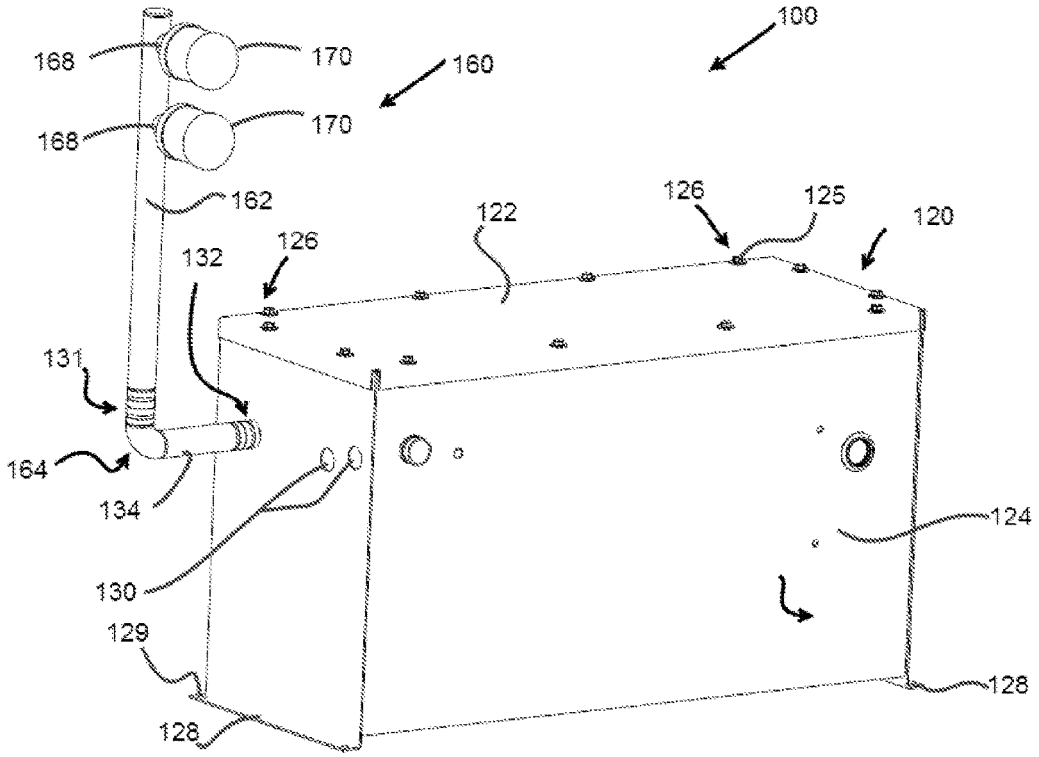
FIG. 3 depicts a perspective view of the under car power unit of FIG. 1, shown separate from the hoistway and showing an embodiment of a snorkel assembly as disclosed herein.

FIG. 3 depicts a perspective view of power unit (100). Power unit (100) comprises a tank (120), and a snorkel assembly (160). Tank (120) comprises a lid (122), and a container (124). In the present example, both lid (122) and container (124) comprise 7 gauge hot rolled steel (HRS), but are not limited to this particular material. Other suitable materials may include stainless steels, other types of carbon steels, aluminum, or the like. In further alternate embodiments, the material used may include alloying additions, such as chromium, to improve corrosion resistance. Corrosion resistance of the lid and container, or any other components, may also be improved with coatings, cladding, and/or paints. Materials having thicknesses other than 7 gauge may be used. Additionally, material type and or thicknesses may be varied between lid (122) and container (124). Other suitable material types and/or thicknesses may be used without departing from the scope of the present disclosure and will be apparent to one of ordinary skill in the art in view of the teachings herein.

Lid (122) and container (124) are configured to be coupled to each other. In the present example, lid (122) is fixedly secured to an upper portion of container (124) by a plurality of mechanical fasteners (126). In the present embodiment, mechanical fasteners (126) are configured as nut and bolt fasteners, though any suitable mechanical fastener may be used. In the present embodiment, as can be seen in FIG. 3, each longitudinal side of lid (122) is configured with four evenly spaced fasteners (126), while each transverse side is equipped with two fasteners (126). Although fasteners (126) are shown as being arranged in a certain configuration, it should be understood that any suitable configuration may be used without departing from the scope of the present disclosure. In embodiments, mechanical fasteners (126) may be omitted entirely and lid (122) may be coupled to container (124) by another suitable joining means such as welding, adhesive bonding, or the like.

Figure 4:
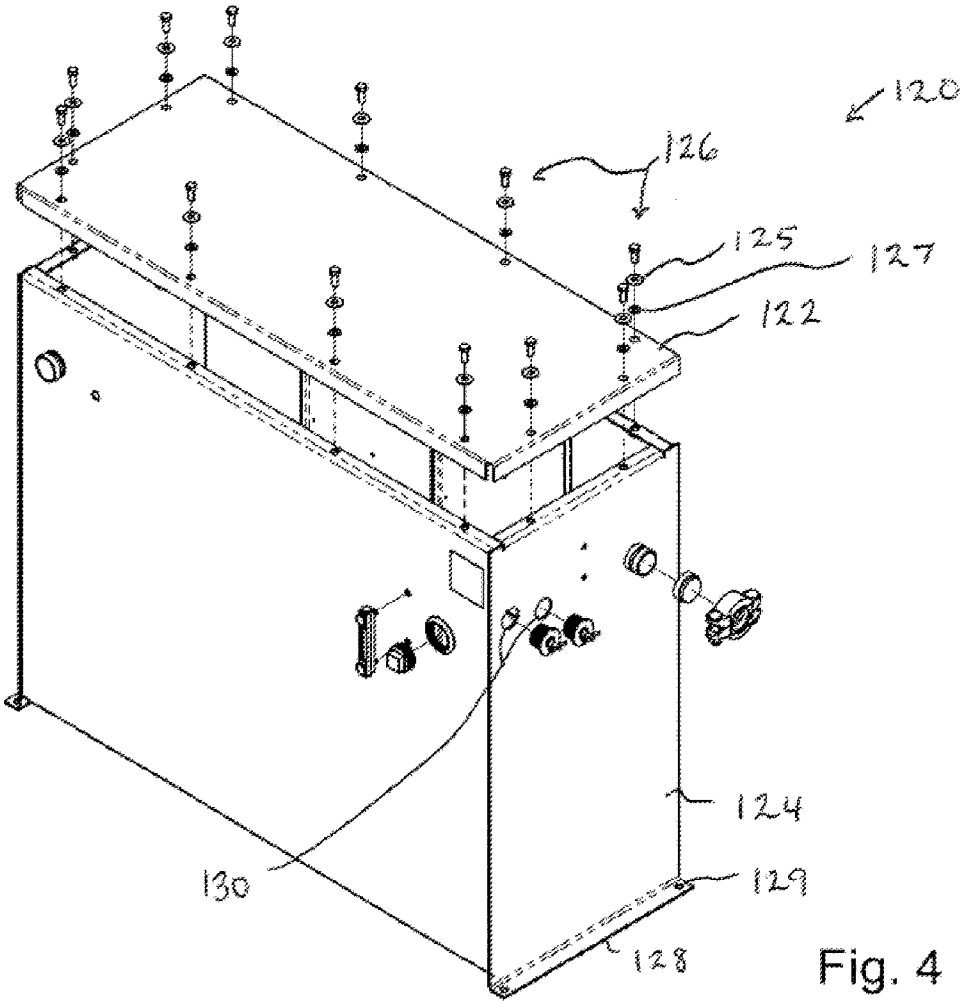
FIG. 4 depicts a partially exploded perspective view of the under car power unit of FIG. 1.
Figure 5:
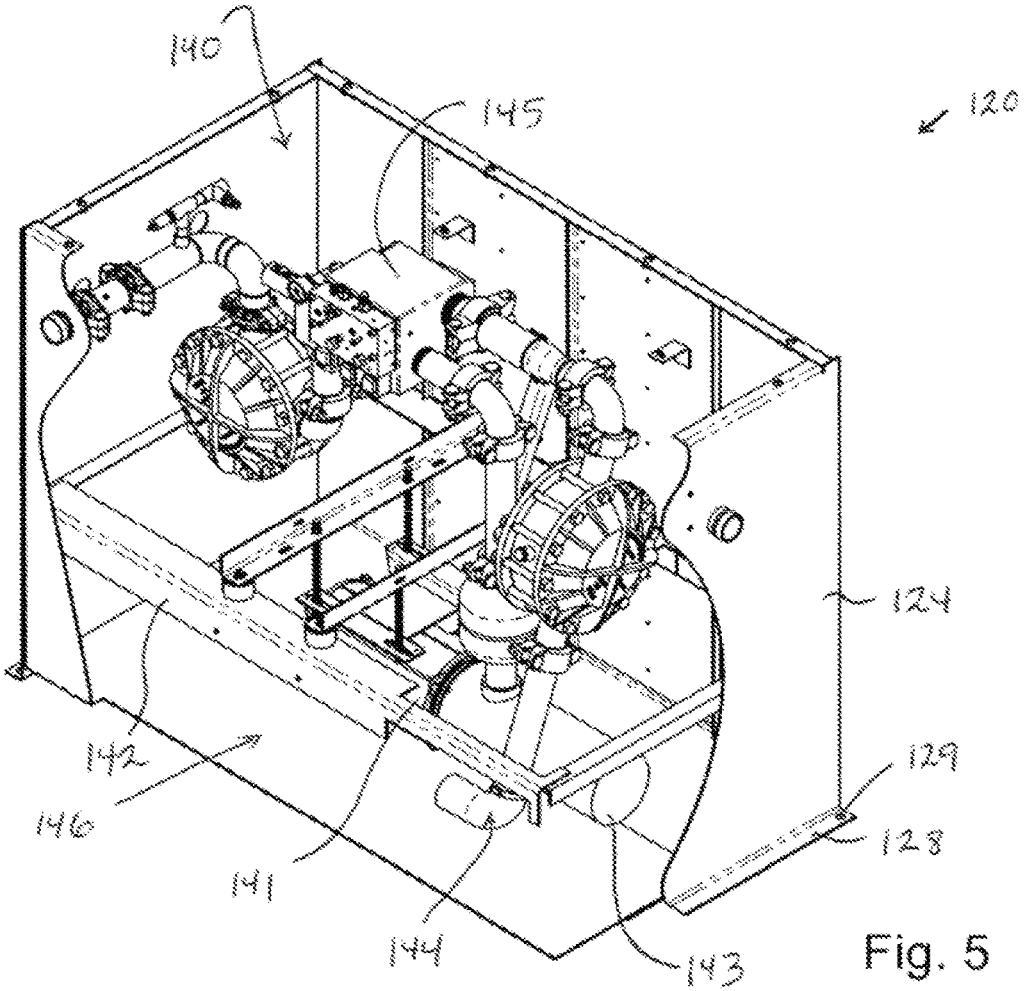
FIG. 5 depicts a cutaway perspective view of the under car power unit of FIG. 1.
Figure 8:
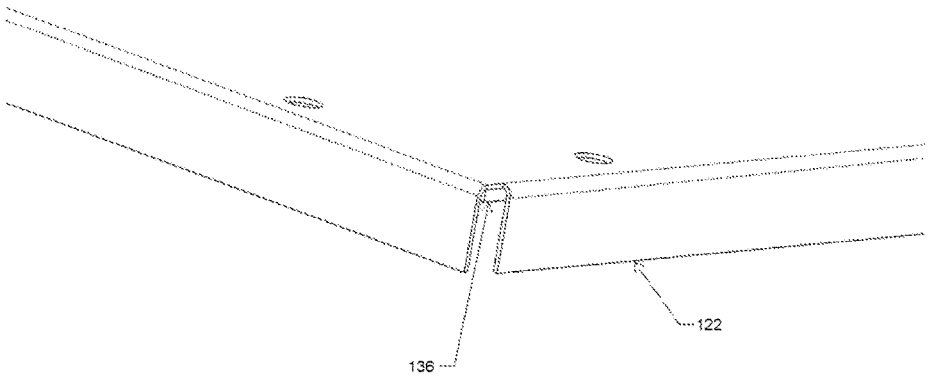
FIG. 8 depicts an embodiment of a seal for the under car power unit of FIGS. 3-5.

Referring to FIG. 5, tank (120) is configured to be water tight so as to protect a drive assembly (140) disposed therein, and prevent contamination of hydraulic fluid contained in the tank (120) if, for example, pit (22) were to flood. Referring to FIG. 8, tank (120) is likewise sealed to prevent hydraulic fluid contained in the tank (120) from contaminating the exterior environment. In particular, the joining surfaces of lid (122) and container (124) may have a seal (136) disposed there between such that when fasteners (126) secure lid (122) to container (124), a water tight seal is formed between lid (122) and container (124). In some embodiments of the present disclosure, the seals described herein may be sufficient to comply with National Electrical Manufacturers Association (NEMA) standards, but is not required in all instances. In some embodiments the seal used with tank (120) may be continuous along all edges of tank (120) where lid (122) meets with container (124). In other embodiments the seals used with tank (120) may be multiple discontinuous seals that extend along edges of tank (120) where lid (122) meets or joins with container (124), as shown in FIG. 8. In still alternate embodiments, multiple separate seals may be used with each fastener (126) to create a water-tight seals at each fastener. For instance, as shown in FIG. 4, fasteners (126) comprise washers (125) and sealing washers (127).

The exterior surfaces of container (124) include a plurality of apertures (130). Apertures (130) are configured to allow communication of various elevator components with drive assembly (140) contained within container (124). For instance, apertures (130) may allow oil lines (110) to pass through container (124). Other apertures (130) may allow electrical lines to pass through container (124) to provide power to drive assembly (140). Other apertures (130) may allow other components, such as a snorkel assembly (160) to connect with tank (120), as will be described in greater detail below with reference to FIG. 3. Still other apertures (130) may provide access to the interior of container (124) for maintenance operations, or for accessing hydraulic fluid within container (124) for draining and/or replacement. Apertures (130) may use seals and/or gaskets and/or water tight fittings to keep water from penetrating tank (120) and to keep hydraulic fluid from escaping tank (120).

In the present embodiment, container (124) is generally shaped as a rectangular cuboid. As will be described in greater detail below, the shape and size of container (124) is generally defined by drive assembly (140) contained therein. Container (124) may also be raised from the floor (21) of pit (22) by a pair of feet (128) extending from the transverse bottom sides of container (124). In alternate embodiments, feet may also extend from the longitudinal bottom sides of container (124). In yet other embodiments, feet (128) may be comprised of a plurality of cylinders extending from the bottom of container (124). Feet (128) provide a structure for connecting or joining tank (120) with the floor (21) of pit (22). In the present embodiment, feet (128) include bores (129) defined therein through which fasteners are used to attach tanks (120) with floor of pit (22) to securely hold tank (120) in position. While the present embodiment depicts tank (120) having feet (128) for elevating the remainder of tank (120) off the floor of pit (22) and securing tank (120) to the floor of pit (22), in other embodiments, feet (128) may be configured differently, replaced by other structures, or omitted entirely.

FIG. 5 depicts a cut away view of tank (120). As can be seen, tank (120) is configured to hold drive assembly (140). Such drive assembly (140) includes motor(s) (141), hydraulic fluid pump(s) (143), piping (144), valve assembly (145), hydraulic fluid holding area(s) (146), etc. Additionally, the inside of tank (120) may include various mounting brackets (142) which may be used to secure drive assembly (140) to the inside of tank (120). Certain drive assembly (140) components can be configured to be submersible, e.g. motor (141) and pump (143), but submersibility is not required in all embodiments.

Referring again to FIG. 3, pumping unit (100) includes snorkel assembly (160) that is configured to provide ventilation to the interior of tank (120) and drive assembly (140) contained therein. Snorkel assembly (160) comprises an elongate vertical tube (162) and a plurality of carbon filters (170) that connect with tube (162) via couplings (168). Carbon filters (170) are configured to remove oil fumes that might otherwise try to escape tank (120) and enter hoistway (20) space. Snorkel assembly (160) further comprises an elbow (164) that is configured to connect vertical tube (162) with a generally horizontal tube (134). Elbow (164) connects with tube (162) via a first fitting (131). Tube (134) extends and connects snorkel assembly (160) with tank (120). In some embodiments, a second fitting (132) is configured to connect tube (134) of snorkel assembly (160) to container (124) of tank (120), and permit snorkel assembly (160) to communicate with the interior of container (124) to allow drive assembly (140) components to breathe.

In this configuration shown and described above, snorkel assembly (160) connects with tank (120) in the area of pit (22), yet extends above bottom landing (36). In this way, snorkel assembly (160) provides ventilation to the interior of tank (120). Furthermore, because of the sealed and water-tight configuration of tank (120) as discussed above, snorkel assembly (160) provides ventilation to the interior of tank (120), and thus drive assembly (140) components, even when pit (22) might contain water or be flooded. Snorkel assembly (162) may extend to other heights above pit (22) as will be apparent to those of ordinary skill in the art in view of the teachings herein.

As discussed above, first and second fittings (132, 134) can be configured to provide water-tight connections between the structures they connect together. Thus the attachment of snorkel assembly (160) with tank (120) is water-tight and only gas can be exchanged between the interior of tank (120) and the exterior of tank (120) through snorkel assembly (160). Other suitable configurations for snorkel assembly (160) and its attachment with tank (120) will be apparent to those of ordinary skill in the art in view of the teachings herein.

Figure 6:
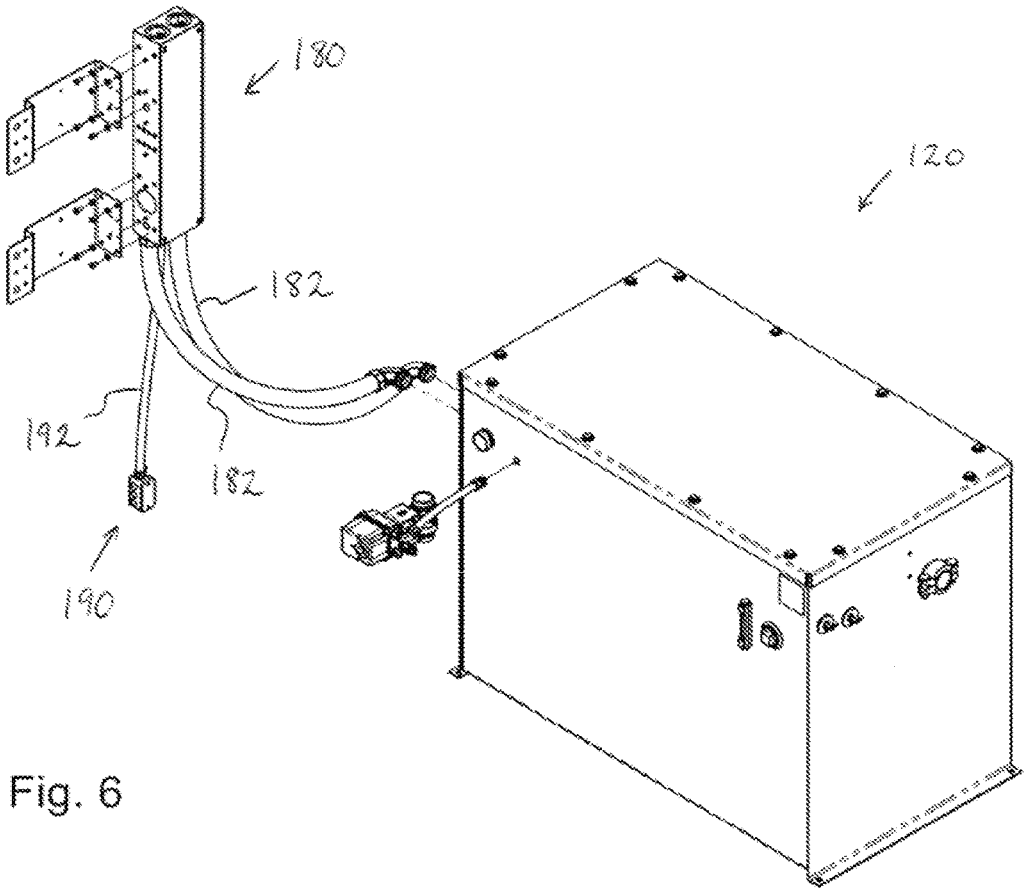
FIG. 6 depicts a partially exploded perspective view of a junction box and an embodiment of a water sensor of the under car power unit of FIG. 1.

FIG. 6 illustrates a partially exploded view of a junction box (180) connecting to tank (120) by way of conduits (182). Junction box (180) may provide electrical communication between controller (60) (see, e.g., FIG. 1), tank (120), and other peripheral components (not shown) of elevator system (10). In particular, junction box (180) may be mounted above pit (22) near or just above bottom landing (36), and a plurality of water tight conduits (182) may extend downwardly from junction box (180) to tank (120).

Junction box (180) is further in electrical communication with and connected to a moisture or water sensor (190) as described in greater detail below with reference to FIG. 7. In particular, junction box (180) is connected to moisture sensor (190) by a water tight conduit (192) extending downwardly from junction box (180) to moisture sensor (190). Although moisture sensor (190) is shown as connecting to junction box (180) via conduit (192), it should be understood that moisture sensor (190) may be configured to connect to tank (120), or directly to controller (60) in other embodiments.

Figure 7:
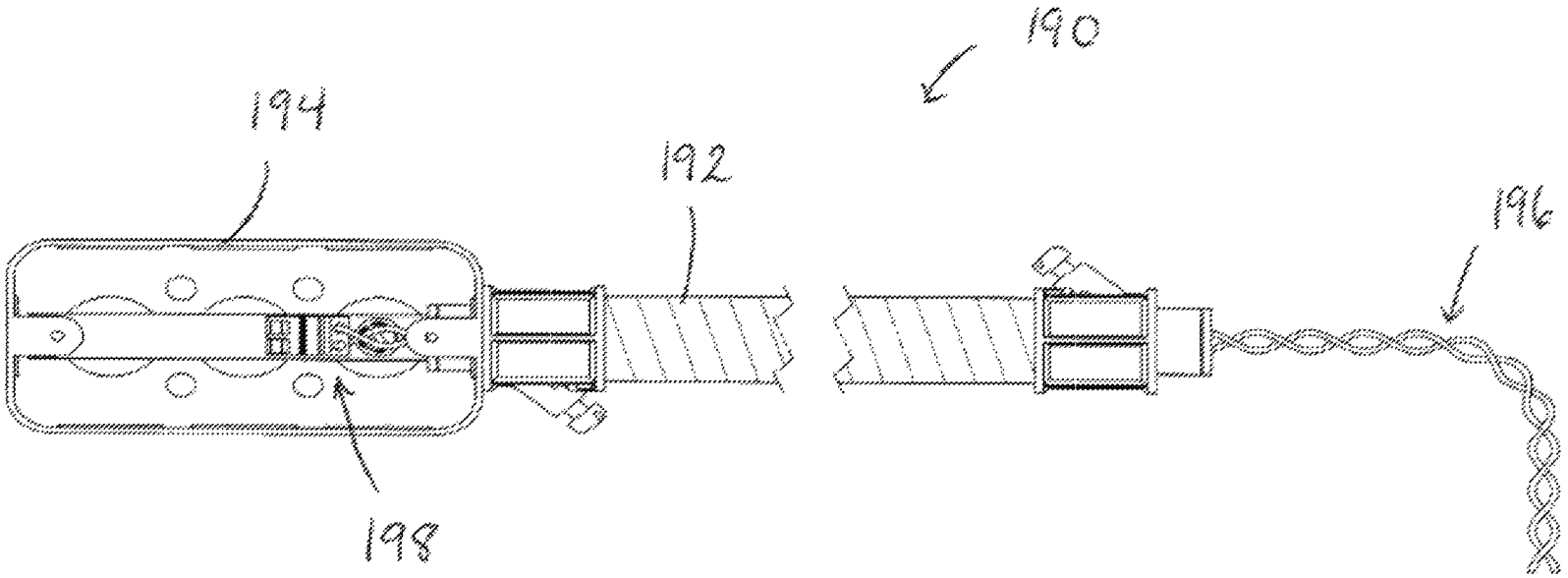
FIG. 7 depicts a front view of the water sensor of FIG. 6.

FIG. 7 illustrates a front view of moisture sensor (190). In particular, moisture sensor (190) comprises a housing (194) connecting to conduit (192), a plurality of wires (196), and a moisture sensing element (198). Housing (194) may contain a printed circuit board (PCB) (not shown) comprising electrical circuitry suitable to process signals from moisture sensing element (198). The moisture sensing element (198) may be configured to send said signals to controller (60) via wires (196) passing through junction box (180) or directly to the controller (60) in some other embodiments. Moisture sensing element (198) may comprise any device suitable for sensing moisture. For instance, in one embodiment, moisture sensing element (198) may comprise two electrodes that form a closed circuit when submerged in water. Of course, any other suitable moisture sensing element (198) may be used without departing from the scope of the present disclosure, as will be apparent to those of ordinary skill in the art in view of the teachings herein. In one embodiment, moisture sensing element (198) comprises a printed circuit board (not shown) having two traces. Moisture sensing element (198) detects resistance between the two traces and if the resistance is sufficiently low (e.g. when water is present and providing a conductive path between the two traces) then a flooded pit (22) may exist. The controller (60) can then respond to the signals that indicate the pit (22) is flooded by controlling and driving the elevator car (30) such that the elevator car (30) does not, or is prevented from, entering a potentially flooded area.

As mentioned, moisture sensor (190) is operable to prevent elevator car (30) from being lowered into a pit (22) that may be flooded. By way of example only, moisture sensor (190) may be mounted slightly above the floor of pit (22), e.g. about 12 inches above the floor such that in the event of a flood, moisture sensor (190) may become submerged in the flood waters. Moisture sensor (190) may then communicate this condition to controller (60), thus initiating a safety sequence. Safety sequence may then prevent elevator car (30) from being lowered into contact with flood waters. Different levels or approaches to the safety response or sequence can be programmed into controller (60) based on the configuration of elevator system (10) and environmental conditions. For instance, in some embodiments a triggering of moisture sensor (190) may cause controller (60) to shut down the elevator car (30) altogether. In other embodiments, triggering the moisture sensor (190) may cause controller (60) to restrict elevator car (30) to only servicing certain floors that are deemed safe or above any flood level. In one embodiment, the moisture sensor (190) can be constructed with conduit and a galvanized junction box so it is protected from any physical damage that might happen in the pit (22), and the moisture sensor (190) can be mounted remotely from the controller (60) so that the controller (60) will not be susceptible to any water damage. Other ways to configure a moisture sensor (190) and a controller (60) as disclosed herein will be apparent to those of ordinary skill in the art in view of the teachings herein, without departing from the scope of the present disclosure.

It should be understood that any one or more of the teachings, expressions, embodiments, examples, etc. disclosed herein may be combined with any one or more of the other teachings, expressions, embodiments, examples, etc. that are disclosed herein. The teachings, expressions, embodiments, examples, etc. disclosed herein should therefore not be viewed in isolation relative to each other. Various suitable ways in which numerous aspects of the present disclosure may be combined will be readily apparent to those of ordinary skill in the art in view of the teachings disclosed herein. Such modifications and variations are intended to be included within the scope of both the present disclosure and the claims.

Having shown and described various embodiments of the present disclosure, further adaptations of the methods and systems described herein may be accomplished by appropriate modifications by one of ordinary skill in the art without departing from the scope of the present disclosure. Several of such potential modifications have been mentioned, and others will be apparent to those skilled in the art. For instance, examples, embodiments, geometries, materials, dimensions, ratios, steps, and the like discussed above are illustrative and are not required. Accordingly, the scope of the present disclosure should be considered in terms of the following claims and is understood not to be limited to the details of structure and operation shown and described in the specification and drawings.

What is claimed is:

1. An apparatus for driving an elevator car of a hydraulic elevator system within a hoistway having a pit, the apparatus comprising:

a tank configured to contain a drive assembly, wherein the tank is water tight; and a snorkel connected to the tank in the area of the pit of the hoistway, wherein the snorkel is configured to allow air to exchange between an interior of the tank and an exterior of the tank, wherein the snorkel extends above the tank to an area above the pit of the hoistway.

2. The apparatus of claim 1, wherein the tank comprises a lid having one or more seals in communication therewith, wherein the one or more seals are configured to prevent moisture from entering the tank.

3. The apparatus of claim 1, further comprising at least one filter connected to the snorkel, wherein the filter is configured to prevent fumes from the interior of the tank escaping to the exterior of the tank.

4. The apparatus of claim 3, wherein the at least one filter comprises a carbon filter.

5. The apparatus of claim 1, wherein the tank is configured to be positioned in the pit below the elevator car and below a bottom landing.

6. The apparatus of claim 5, wherein the snorkel extends above the bottom landing.

7. The apparatus of claim 1, wherein the tank is raised from a floor of the pit by a plurality of feet.

8. The apparatus of claim 1, wherein the tank is made from a corrosion resistant material.

9. The apparatus of claim 1, wherein the tank is sealed to NEMA 6 standards.

10. The apparatus of claim 1, further comprising:

an elevator controller; and a moisture sensor in electrical communication with the elevator controller, wherein the moisture sensor is configured to detect the presence of moisture and signal to the elevator controller that moisture is present, and wherein the elevator controller is configured to restrict the position of the elevator car in response to detected moisture indicated by the moisture sensor.

11. The apparatus of claim 10, wherein the moisture sensor is configured to be positioned within the pit.

12. The apparatus of claim 11, wherein the moisture sensor is configured to be positioned about twelve inches above the floor of the pit.

13. A hydraulic elevator system having an elevator car positioned within a hoistway having a pit defined at a bottom of the hoistway, the elevator system comprising:

a tank;

a drive assembly disposed within the tank and positionable within the pit below a bottom landing of the hoistway;

a hollow tube sealingly coupled to the tank disposed within the pit and extending vertically upward from the pit to a position above the bottom landing, wherein the tube is configured to provide ventilation to the tank containing the drive assembly disposed therein; and an elevator controller in communication with the drive assembly, configured to control operation of the drive assembly.

14. The system of claim 13, further comprising:

a moisture sensor configured to detect the presence of moisture within the pit and signal to the elevator controller that moisture has been detected within the pit.

15. The system of claim 14, wherein in response to detection of moisture within the pit, the elevator controller is configured to restrict movement of the elevator car to prevent the elevator car from entering potentially flooded areas within the hoistway.

16. The system of claim 13, wherein the controller is mounted to a door frame of a second floor landing.

17. The system of claim 1, wherein the tube comprises at least one carbon filter configured to filter hydraulic oil fumes from air exiting the tank.

18. A method of controlling an elevator car in a hoistway having a flooded pit, the method comprising the steps of:

determining the presence of moisture within the pit by use of a moisture sensor positioned within the pit and electrically connected to an elevator controller;

sending a signal from the moisture sensor to the elevator controller upon a determination that moisture is present at the location of the moisture sensor disposed within the pit;

restricting the travel of the elevator car within the hoistway to a predetermined area of the hoistway considered safe from flooding, upon receipt by the elevator controller of a signal indicating that moisture is present at the location of the moisture sensor disposed within the pit; and ventilating a water-tight tank containing a drive assembly using a snorkel connected to the water-tight tank.

* * * * *